US009318007B2

(12) United States Patent
Valiulis et al.

(10) Patent No.: US 9,318,007 B2
(45) **Date of Patent: *Apr. 19, 2016**

(54) SIGNAL EMITTING RETAIL DEVICE

(71) Applicants: Peter T. Valiulis, Rockford, IL (US); Thomas E. Valiulis, Rockford, IL (US)

(72) Inventors: Peter T. Valiulis, Rockford, IL (US); Thomas E. Valiulis, Rockford, IL (US)

(73) Assignee: Southern Imperial, Inc., Rockford, IL (US)

( * ) Notice: Subject to any disclaimer, the term of this patent is extended or adjusted under 35 U.S.C. 154(b) by 166 days.

This patent is subject to a terminal disclaimer.

(21) Appl. No.: 14/081,538

(22) Filed: Nov. 15, 2013

(65) Prior Publication Data

US 2014/0070948 A1 Mar. 13, 2014

Related U.S. Application Data

(63) Continuation of application No. 13/312,699, filed on Dec. 6, 2011, now Pat. No. 8,629,772.

(51) Int. Cl.
*A47F 5/08* (2006.01)
*G08B 13/14* (2006.01)

(52) U.S. Cl.
CPC ..... *G08B 13/14* (2013.01); *A47F 5/0823* (2013.01); *A47F 5/0861* (2013.01); *G08B 13/149* (2013.01)

(58) Field of Classification Search
CPC .... G08B 13/14; G08B 13/149; A47F 5/0823; A47F 5/0861
See application file for complete search history.

(56) References Cited

U.S. PATENT DOCUMENTS

| | | | |
|---|---|---|---|
| 4,383,242 | A | 5/1983 | Sassover et al. |
| 4,718,626 | A | 1/1988 | Thalenfeld et al. |
| 5,068,643 | A | 11/1991 | Yashina |
| 5,168,263 | A | 12/1992 | Drucker |
| 5,317,304 | A | 5/1994 | Choi |
| 5,434,559 | A | 7/1995 | Smiley et al. |
| 5,570,080 | A | 10/1996 | Inoue et al. |
| 5,757,270 | A | 5/1998 | Mori |
| 5,838,225 | A | 11/1998 | Todd |
| 5,955,951 | A | 9/1999 | Wischerop et al. |
| 5,979,674 | A | 11/1999 | Thalenfeld |
| 6,049,268 | A | 4/2000 | Flick |
| 6,133,830 | A | 10/2000 | D'Angelo et al. |
| 6,279,256 | B1 | 8/2001 | Norolof et al. |

(Continued)

FOREIGN PATENT DOCUMENTS

| | | | |
|---|---|---|---|
| KR | 100823026 | B1 | 4/2008 |
| KR | 20100137956 | A | 12/2010 |

(Continued)

OTHER PUBLICATIONS

Indyme smartresponse; 2 pages printed from internet http://www.indyme.com/; date last visited Apr. 8, 2013.

*Primary Examiner* — Brian Zimmerman
*Assistant Examiner* — Sara Samson
(74) *Attorney, Agent, or Firm* — Reinhart Boerner Van Deuren P.C.

(57) ABSTRACT

A signal emitting retail device is provided. The signal emitting retail device includes a sensor and an emitter. The emitter is configured to emit a signal when the sensor senses removal of merchandise from a merchandise display structure. The sensor is also configured to sense potential theft conditions. The emitter is configured to emit a signal indicative of potential theft conditions when such conditions are sensed by the sensor.

11 Claims, 11 Drawing Sheets

(56) References Cited

U.S. PATENT DOCUMENTS

| | | | | |
|---|---|---|---|---|
| 6,373,381 | B2 | 4/2002 | Wu | |
| 6,517,000 | B1 | 2/2003 | McAllister et al. | |
| 6,690,411 | B2 | 2/2004 | Naidoo et al. | |
| 6,967,578 | B1 | 11/2005 | Guida | |
| 7,059,518 | B2 * | 6/2006 | Forster | 235/385 |
| 7,202,784 | B1 * | 4/2007 | Herwig | 340/568.1 |
| 7,530,188 | B2 | 5/2009 | Beilenhoff et al. | |
| 7,584,930 | B2 | 9/2009 | Zich | |
| 7,591,422 | B2 | 9/2009 | Maitin | |
| 7,671,741 | B2 | 3/2010 | Lax et al. | |
| 7,671,742 | B2 | 3/2010 | Fallin et al. | |
| 7,768,399 | B2 * | 8/2010 | Hachmann et al. | 340/568.1 |
| 7,969,305 | B2 | 6/2011 | Belden, Jr. et al. | |
| 8,274,391 | B2 | 9/2012 | Yang | |
| 8,378,826 | B2 | 2/2013 | Mercier et al. | |
| 8,534,469 | B2 | 9/2013 | Northrup, Jr. et al. | |
| 2002/0067259 | A1 | 6/2002 | Fufidio et al. | |
| 2002/0130776 | A1 | 9/2002 | Houde | |
| 2003/0030548 | A1 | 2/2003 | Kovacs et al. | |
| 2003/0175004 | A1 | 9/2003 | Garito et al. | |
| 2003/0227382 | A1 | 12/2003 | Breed | |
| 2004/0145477 | A1 | 7/2004 | Easter et al. | |
| 2005/0104733 | A1 | 5/2005 | Campero | |
| 2006/0198611 | A1 | 9/2006 | Park | |
| 2008/0307687 | A1 | 12/2008 | Nagel et al. | |
| 2008/0309489 | A1 | 12/2008 | Hachmann et al. | |
| 2009/0095695 | A1 | 4/2009 | Moock et al. | |
| 2009/0109027 | A1 | 4/2009 | Schuller | |
| 2010/0097223 | A1 | 4/2010 | Kruest et al. | |
| 2010/0175438 | A1 | 7/2010 | Sankey | |
| 2010/0238031 | A1 | 9/2010 | Belden, Jr. et al. | |
| 2011/0215060 | A1 | 9/2011 | Niederhuefner | |
| 2011/0227735 | A1 | 9/2011 | Fawcett et al. | |
| 2013/0142494 | A1 | 6/2013 | Valiulis et al. | |
| 2014/0055264 | A1 | 2/2014 | Valiulis | |
| 2014/0055266 | A1 | 2/2014 | Valiulis | |
| 2014/0070948 | A1 | 3/2014 | Valiulis et al. | |

FOREIGN PATENT DOCUMENTS

| | | | |
|---|---|---|---|
| KR | 2020110002261 | U | 3/2011 |
| KR | 20110043837 | A | 4/2011 |
| KR | 20110080411 | A | 7/2011 |
| WO | WO 97/40724 | A1 | 11/1997 |
| WO | WO 99/27824 | A1 | 6/1999 |
| WO | WO 01/81988 | A2 | 11/2001 |
| WO | WO 2011/025085 | A1 | 3/2011 |

* cited by examiner

SIGNAL EMITTING RETAIL DEVICE

CROSS-REFERENCE TO RELATED PATENT APPLICATIONS

This patent application is a Continuation of co-pending U.S. patent application Ser. No. 13/312,699, filed Dec. 6, 2011, the entire teachings and disclosure of which are incorporated herein by reference thereto.

FIELD OF THE INVENTION

This invention generally relates to systems used in retail, and more particularly to anti-theft systems operable to indicate when an item of merchandise has been removed from a retail display.

BACKGROUND OF THE INVENTION

Loss prevention is a continuing problem in the retail industry. Current anti-theft systems involve locking up merchandise behind counters, far away from related merchandise, or locking up the merchandise in secure cabinets, closer to the place where related merchandise is generally stored.

There are disadvantages to each of these methods. When merchandise is stored in a secured location away from the point of storage of related items, sales of the secured merchandise decrease because customers are less likely to go out of their way to locate a sales associate to retrieve the merchandise. Also, sales of related items that would otherwise be situated in proximity to the secured merchandise decrease as well because the customer is not drawn to their location.

Therefore, although common anti-theft systems may be effective at preventing loss, they also have the significantly negative impact of reducing sales.

Accordingly, there exists a need in the art for an anti-theft system for retail stores that will deter theft without discouraging the sale of the merchandise and related items. Additionally, the anti-theft system should be able to be retrofitted onto existing retail displays to keep the cost of installation and the shelving downtime required for installation as low as possible.

The invention provides such an anti-theft system. This and other advantages of the invention, as well as additional inventive features, will be apparent from the description of the invention provided herein.

BRIEF SUMMARY OF THE INVENTION

In one aspect, an audible alarm emitting signal retail device is provided. The device includes a top wire supporting a label holder. The device further includes a bottom wire spaced apart from the top wire and configured to support merchandise. The label holder is actuateable between a first configuration in which merchandise is prevented from being removed from the bottom wire and a second configuration in which merchandise is allowed to be removed from the bottom wire. The device also includes an electronic unit including a sensor coupled with an emitter and the timer. The sensor is configured to sense actuation of the label holder between the first configuration and the second configuration. The timer is configured to determine the amount of time that the label holder is in the second configuration. The emitter is configured to emit an audible alarm signal when the amount of time the label holder is in the second configuration exceeds a predetermined amount of time.

In one embodiment the emitter is configured to emit a first audible signal indicative of a non-potential threat condition when the label holder is in the second configuration for a non-zero amount of time less than the predetermined amount of time. In one embodiment the predetermined amount of time is adjustable. In one embodiment the device further includes a power source. The sensor includes a switch having an open configuration and a closed configuration, a first contact electrically connected to a power supply, and a second contact electrically connected to the emitter, such that when the switch is in the open configuration, the power supply does not supply power to the emitter, and when the switch is in the closed configuration the power supply supplies power to the emitter. In one embodiment the switch is in the open configuration when the label holder is in the first configuration. The switch is in the closed configuration when the label holder is in the second configuration. In one embodiment the device includes a magnet coupled with the label holder. The sensor includes a reed switch. Actuation of the label holder actuates the reed switch between its open and closed configurations.

In one embodiment a signal emitting retail device is provided. The device includes a first merchandise support portion and a second portion actuateable between a first configuration in which merchandise is prevented from being removed from the merchandise support portion and a second configuration in which merchandise is allowed to be removed from the merchandise support portion. The device includes an electronic unit including a sensor coupled with an emitter. A sensor is configured to sense when the second portion is actuated from the first configuration to the second configuration. The emitter is configured to emit a signal based on the sensor sensing that the second portion has been actuated from the first configuration to the second configuration.

In one embodiment the first merchandise support portion includes a bottom wire configured to support merchandise. The signal emitting retail device also includes a top wire configured to support the second portion. The top wire extends generally parallel with the bottom wire. The second portion includes a locking mechanism biased towards the second configuration. Actuation of the locking mechanism activates the electronic unit. The bottom wire is configured to support a lock arranged to maintain the locking mechanism in the first configuration when the electronic unit is to be maintained in a deactivated configuration. In one embodiment the device includes a timer. The timer begins measuring time on actuation of the second portion of the first configuration to the second configuration. If the amount of time measured by the timer exceeds a predetermined amount of time, the emitter is configured to emit a signal indicative of a potential theft condition. In one embodiment the second portion may lock in the first configuration upon sensing of a potential theft condition. In one embodiment the emitter is configured to emit a first audible signal when the sensor senses that the second portion has been actuated between the first configuration and the second configuration. The emitter is configured to emit a second audible signal when the amount of time exceeds the predetermined amount of time. The first audible signal and the second audible signal are each of at least one of different frequencies, wavelengths, pitches, frequencies of occurrence and volumes. In one embodiment the emitter is configured to emit at least one of audible sound waves, infrared, visible light, radio waves, and microwaves.

In one embodiment and electronic unit for a signal emitting retail device is provided. The unit includes an emitter coupled with a sensor. The electronic unit is configured to couple with a device for displaying merchandise. The sensor is configured to detect at least one of removal of merchandise from the device for displaying merchandise and actuation of the device for displaying merchandise. The emitter is configured to emit a signal upon sensing by the sensor of at least one of removal of merchandise from the device for displaying merchandise and actuation of the device for displaying merchandise.

In one embodiment the sensor includes a switch having an open position and an closed position, a first contact electrically connected to a power supply, and a second contact electrically connected to the emitter. When the switch is in the open position, the power supply does not supply power to the emitter. When the switch is in the closed position the power supply supplies power to the emitter. In one embodiment the sensor is configured to sense a first condition wherein merchandise removal from the device for displaying merchandise indicates a non-potential theft condition. The sensor is also configured to sense a second condition wherein merchandise removal from the device for displaying merchandise indicates a potential theft condition. The emitter is configured to emit a first signal indicative of a non-potential theft condition when a non-potential theft condition is sensed by the sensor and to emit a second signal indicative of a potential theft condition when a potential theft condition is sensed by the sensor. In one embodiment the device for displaying merchandise includes a display hook including a device actuateable between a first configuration in which removal of merchandise from the display hook is prevented and a second configuration in which removal of merchandise from the display hook is allowed. The electronic unit further includes a timer. The timer is configured to measure time that the device is in the second configuration. The emitter is configured to emit a first signal indicative of a non-potential theft condition when the amount of time that the device is in the second configuration is less than a predetermined amount and to emit a second signal indicative of a potential theft condition when the amount of time the device is in the second configuration is more than a predetermined amount. In one embodiment the electronic unit determines the frequency with which merchandise is removed from the display hook. The emitter is configured to emit an audible signal. The audible signal increases in one of pitch, frequency, decibel level, or frequency of occurrence when a frequency greater than or equal to a predetermined frequency is determined. In one embodiment the predetermined amount is adjustable. In one embodiment the device for displaying merchandise with which the electronic unit is configured to couple with is one of a unit of shelving and a cabinet. In one embodiment the signal identifies the electronic unit.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now to the drawings, embodiments of the present invention provide a signal emitting retail device that, when used in various arrangements of an audible anti-theft system, will deter theft without discouraging the sale of merchandise.

Figure 1:
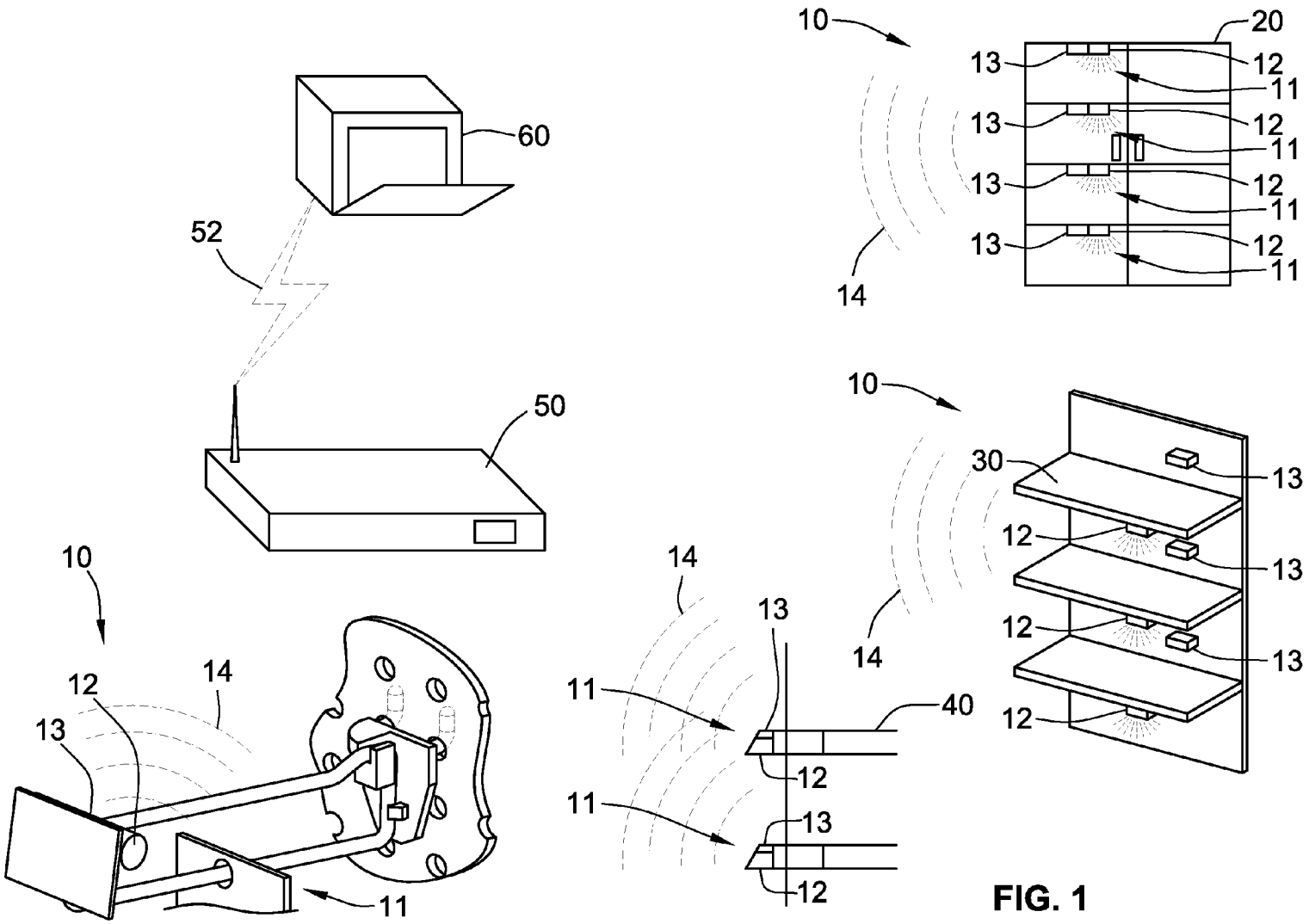
FIG. 1 is a perspective view of a signal receiver, an output receiving device, and retail display devices including embodiments of signal emitting retail devices, such as an audible alarm sounding retail devices, according to the teachings of the present invention, arranged as component in a theft deterrent system, such as an audible anti-theft system.

FIG. 1 depicts various embodiments of retail display devices 10, such as, in one embodiment, retail display devices configured to emit alarm signals, such as audible alarm signals, in a first arrangement of an embodiment of a theft deterrent system, such as, in one embodiment, an audible anti-theft alarm system. The theft deterrent system further includes an embodiment of a signal receiver unit 50, such as, in one embodiment, an audible alarm receiver unit and an output receiving device 60, such as, in one embodiment, a computer.

Use of various suitable signal receiver units is envisioned. One such signal receiver unit that may be utilized in embodiments of theft deterrent systems described herein is further described in U.S. patent application Ser. No. 13/312,644, filed on Dec. 6, 2011, entitled Retail System Signal Receiver Unit, which is incorporated by reference thereto in its entirety.

The retail display devices 10 include signal emitting retail devices 11 adapted to emit a signal 14 when merchandise is removed from the retail display devices or when the retail display devices are actuated to allow for merchandise to be removed. The signal emitting retail devices 11 including an emitter 12 and a sensor 13. In some embodiments the emitter 12 and sensor 13 may be arranged in a single housing. In other embodiments, the emitter 12 and sensor 13 may be separate units in operative communication. The sensor 13 is arranged and configured in some embodiments to sense when a retail display device 10 is actuated to allow for removal of merchandise, such as, for example, to sense when a door of a display case is opened or when a label holder blocking removal of merchandise in a first configuration is moved to a second configuration in which merchandise is allowed to be removed. In other embodiments, a sensor 13 is arranged and configured to sense when merchandise is removed from a shelf. Sensors 13 may be motion sensors, inductive sensors, capacitive sensors, optical sensors, piezo electric sensors, or any other type of sensor known in the art for determining when merchandise is removed from a retail display device 10 or when a retail display device 10 is actuated to allow removal of merchandise. Specific embodiments of sensor arrangements will be discussed further below.

In one embodiment the emitters 12 of the signal emitting retail devices 11 are also adapted to transmit signals, such as, in one embodiment audible alarms, for example and as will be discussed further below, increasing in pitch, frequency, frequency of occurrence, or decibel level, when a condition is sensed by sensors 13 that would indicate a potential theft condition. Such conditions are further discussed below.

In a first embodiment of a theft deterrent system, with reference to FIG. 1, signals 14 emitted by the signal emitting retail devices 11 are received by the receiver unit 50. The receiver unit 50 is configured to receive and process these signals 14. The signals 14 may include a variety of information for the receiver unit 50, including identification of the particular retail display unit 10 from which the signal was emitted, an identification of whether an item of merchandise has been removed, the retail display unit 10 has been actuated, or a potential theft condition exists. The receiver unit 50 receives the signals 14, processes and determines the information contained therein, and sends a signal 52 to an output receiving device 60.

In one embodiment, the emitters 12 may include a speaker or speakers and are configured to emit audible signals. In various embodiments the frequency of occurrence, decibel level, or pitch of the audible signal indicate to the receiver unit 50 the retail display unit 10 from which the audible signal was emitted, whether there is a normal condition that indicates a regular customer removal of merchandise from a retail display unit 10 or a customer actuating a retail display unit 10 to remove an item of merchandise, or whether a potential theft condition exists to which store personnel should be alerted. The receiver unit 50 then sends a signal 52, if appropriate, to an output receiving device 60 to alert store personnel to the potential theft condition. This first arrangement may be effective in large retail environments where store personnel may be too far away to hear a particular audible signal indicating a potential theft condition.

In one embodiment, the output receiving device 60 may be a computer, a pager, a cellular telephone, a public address system, a memory, a camera, a video camera, or any other device capable of receiving a signal 52. The receiving device 60 may be networked with other receiving devices located on or off site, or may be a stand alone unit located on or off site relative to a retail establishment.

In another embodiment, signal emitting retail devices 11 deter theft and alert store personnel when a potential theft condition has occurred simply by emitting an audible alarm signal to be heard by store personnel and a potential thief. This embodiment may be particularly effective in smaller retail environments where store personnel are likely to be close enough to hear the audible alarm signal. In some embodiments, the audible alarm signal may be a siren, a pre-recorded message, a buzzer, or any other suitable alarm signal.

In another embodiment the signal emitting retail devices 11 may be configured to emit various other types of encoded signals using any suitable protocol. The signals emitted may include at least one of an audible sound, infrared light, visible light, radio waves, and microwaves. Additionally, the signal 52 emitted by the receiver unit 50 may be of any suitable type and may be an encoded signal using any suitable protocol.

It will be understood that the signal emitting retail devices 11 can be used in many different arrangements, and the quantity and type of signal emitting retail devices 11 and other components shown are exemplary and for illustrative purposes only.

Figure 2:
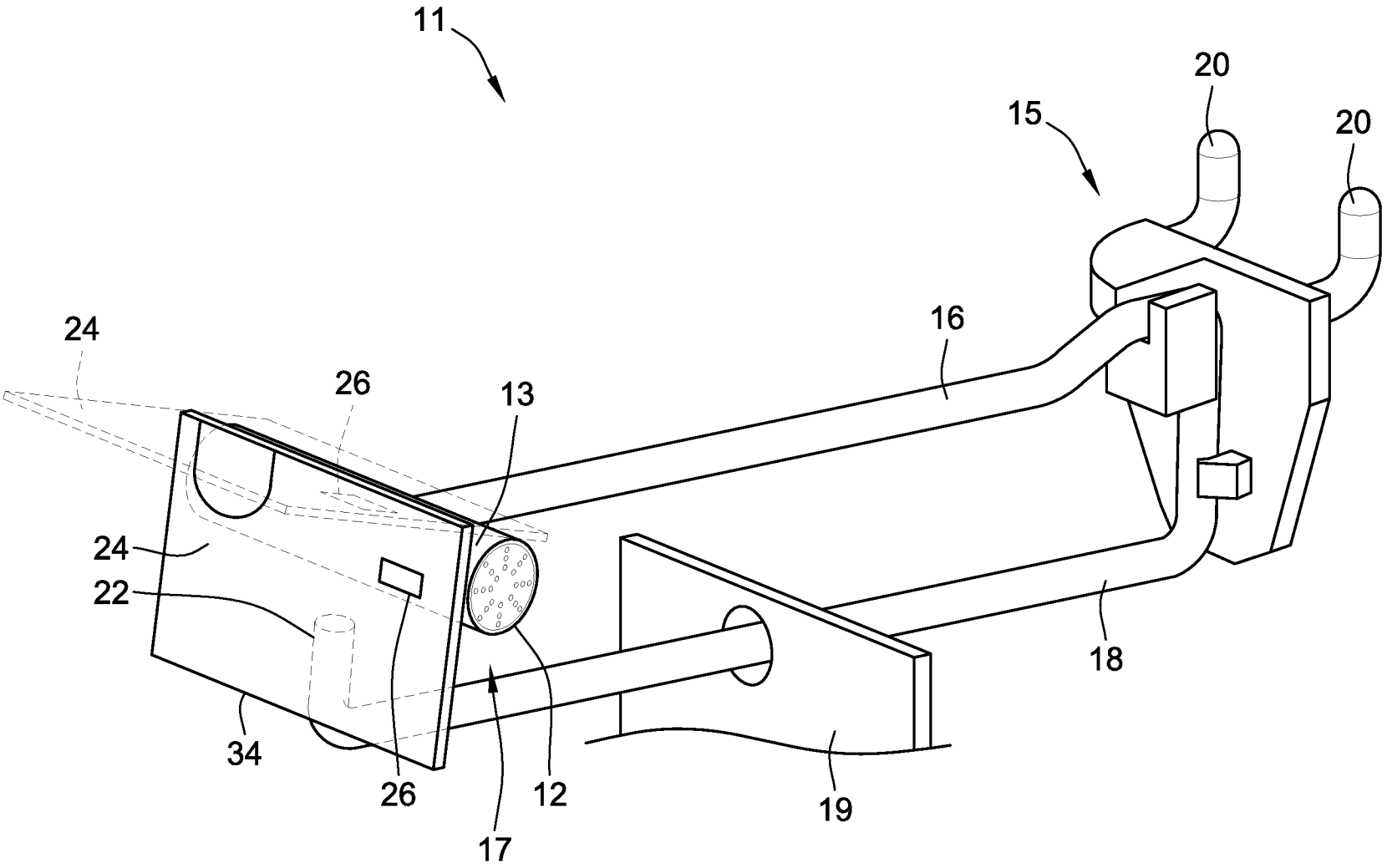
FIG. 2 is a detailed view of a signal emitting retail device of FIG. 1.

With reference to FIG. 2, the structural elements of an embodiment of a signal emitting retail device 11 are discussed. The signal emitting retail device 11 includes a display interfacing portion 15. The display interface portion 15 includes upturned hooks 20 adapted to fit in a pegboard style mounting surface to support the signal emitting retail device 11. However many other mounting arrangements are also envisioned, including mounting arrangements adapted to be installed on slatwall and wire cage type retail display surfaces.

With reference to FIG. 2, in one embodiment, extending from the display interfacing portion 15 in a direction opposite the upturned hooks 20, the signal emitting retail device 11 includes a top wire 16, a bottom wire 18, extending generally parallel with one another. This arrangement illustrated in FIG. 2 may be referred to as a hook or a display hook. The top wire 16 extends from the display interfacing portion 15 to an electronic unit 17 including an emitter 12 and a sensor 13. The electronic unit 17 is supported by the top wire 16 and fixedly attached to the end of the top wire 16 distal from display interfacing portion 15. The electronic unit 17 extends generally orthogonal to the top wire 16.

With further reference to FIG. 2, in one embodiment, rotatably coupled to the electronic unit 17 is a label holder 24. The label holder 24 is adapted to hold any suitable label, for example, for displaying relevant information regarding merchandise, such as price, description of the merchandise, etc. The label holder 24 rests in a normal position hanging from the electronic unit 17. The label holder 24 can also be actuated by a customer by pivotally rotating the label holder 24 upward to a second, merchandise removal configuration (label holder 24 in second configuration shown in phantom lines). The label holder 24 extends from the top wire 16 at about a ninety degree angle relative thereto toward the bottom wire 18.

In other embodiments, the label holder 24 is displaceable in other manners. For example, in one embodiment the label holder is slidably displaceable upwardly relative to the electronic unit 17 and the top wire 16. Other suitable types of displacement are also envisioned.

With further reference to FIG. 2, the bottom wire 18 extends from the display interfacing portion 15, spaced apart from the top wire 16. The bottom wire 18 is configured to support merchandise 19 with packaging defining an aperture for receiving the bottom wire 18. The bottom wire 18 includes an upturned segment 22 at the end of the bottom wire 18 distal from the interfacing portion 15. The upturned segment 22 extends at an approximately 90 degree angle relative to the rest of the bottom wire 18, toward the top wire 16. The upturned segment 22 is located closer to the display interfacing portion 15 than the label holder 24, and thus the label holder 24 would be located between the upturned segment 22 and a customer.

In one embodiment the top and bottom wires 16 and 18 may be portions of a single wire bent proximate a median point, with the bent portion mounted to the display interfacing portion 15. In another embodiment the wires 16 and 18 may be separate wires. The signal emitting retail device 11 may have different overall lengths and distances between the top and bottom wires 16 and 18 in order to accommodate different types of merchandise. The top and bottom wires 116 and 118 of the signal emitting retail device 11 may be made of any suitable rigid material, including but not limited to a rigid metal or plastic.

With further reference to FIG. 2, in one embodiment the signal emitting retail device 11 also includes a magnet 26. The magnet 26 is fixedly attached to an inner surface (e.g., a surface of a slot for inserting a label into the label holder 24) of the label holder 24. The label holder 24 is arranged such that when it is in its resting, hanging first configuration, the magnet 26 is proximate the electronic unit 17.

Figure 3:
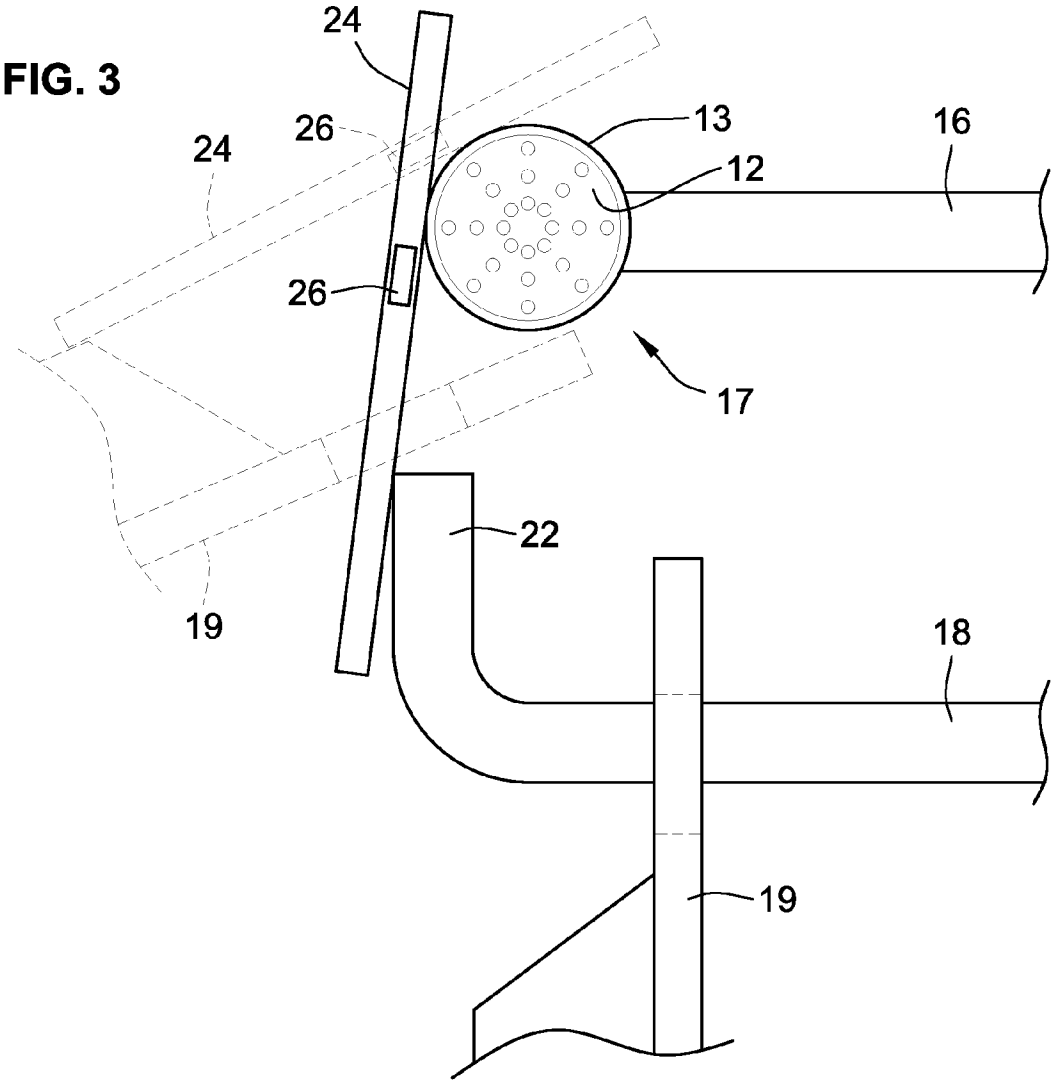
FIG. 3 is a side view of the signal emitting retail device of FIG. 2 illustrating actuation of a label holder and removal of merchandise.

With reference to FIG. 3, when the label holder 24 is in the resting, hanging first configuration, its inner surface 21 is proximate to the upturned segment 22 of the bottom wire 18. As such, in order for the merchandise 19 to be removed from the bottom wire 18, the label holder 24 must be lifted from the resting configuration to a second merchandise removal configuration (shown in dashed lines). When the label holder 24 is in this second configuration, the magnet 26 that is fixedly attached to the label holder 24 is no longer in a position proximate the electronic unit 17. As is discussed in further detail below, the removal of the magnet 126 from a position proximate the electronic unit 17 causes the electronic unit 17 to emit a signal 14.

Figure 4:
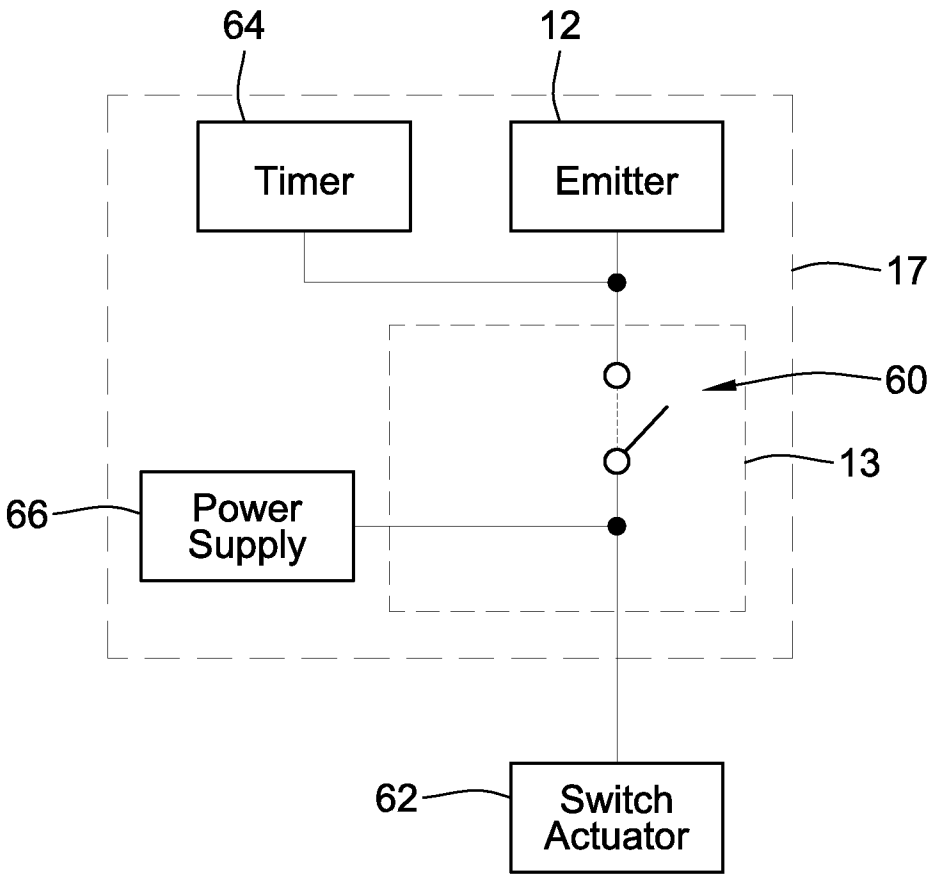
FIG. 4 is schematic representation of components of the signal emitting retail device of FIGS. 2 and 3.

With reference to FIG. 4, a functional schematic of the internal components of an embodiment of a retail display device 10 is discussed. The electronic unit 17 includes the emitter 12 and the sensor 13. The sensor 13 includes a switch 60, which is adapted to transition between an open configuration (shown in solid lines) and a closed configuration (shown in dashed lines) upon actuation by an external switch actuator 62. The switch 60 may include any suitable type of switching device capable of transitioning between at least a first state and a second state. The external switch actuator 62 may include various different actuators, including physical actuators, magnetic actuators, electrical actuators, and any other suitable type of actuator known in the art. Particular embodiments of actuators are discussed further below.

With further reference to FIG. 4, in one embodiment the electronic unit 17 also includes a power supply 66. The power supply 66 may be any suitable type of battery, a solar power collector, or any other type of power supply. In one embodiment the power supply 66 may be external to the electronic unit 17, and may be any suitable type of power supply.

In one embodiment the electronic unit 17 also includes a timer 64, which is electrically coupled with the emitter 12. The timer 64 is also electrically coupled with the power supply 66 through the switch 60 when the switch 60 is the closed configuration. As will be further described below, the timer 64 is configured to determine, keep track of, etc. the amount of time between when the switch 60 closes and when the switch 60 opens. If the timer 64 measures an amount of time that is less than a predetermined amount of time, the emitter 12 emits a signal indicative of a normal condition of a piece of merchandise being removed from a signal emitting retail device 11. However, if the amount of time measured by the timer 64 exceeds the predetermined amount of time, the emitter 12 emits a second signal indicative of a potential theft condition. The predetermined amount of time may be adjusted and set to a greater or lesser amount of time by a user.

In one embodiment, the emitter 12 is configured to emit audible signals. In this embodiment, the second signal indicative of a potential theft condition may be of a different pitch, frequency, decibel level, wavelength, frequency of occurrence, etc. than the signal indicative of a normal condition in which a piece of merchandise is removed. Additionally, the second signal indicative of a potential theft condition may include a pre-recorded or pre-generated message including words. In this embodiment, the signal receiver unit 50 (illustrated in FIG. 1) may be configured to monitor for, distinguish, recognize, and respond to the variety of pitches, frequencies, wavelengths, frequencies of occurrence, and decibel levels of signals emitted by the emitter 12.

In another embodiment, with further reference to FIG. 4, upon closing of the switch 60, the emitter 12 is configured to emit a signal indicative of a normal condition of removal of a piece of merchandise and the timer 64 is configured to begin timing. If the timer 64 exceeds the preset time before the switch 60 is opened, the emitter 12 emits a signal indicative of a potential theft condition.

Figure 5A:
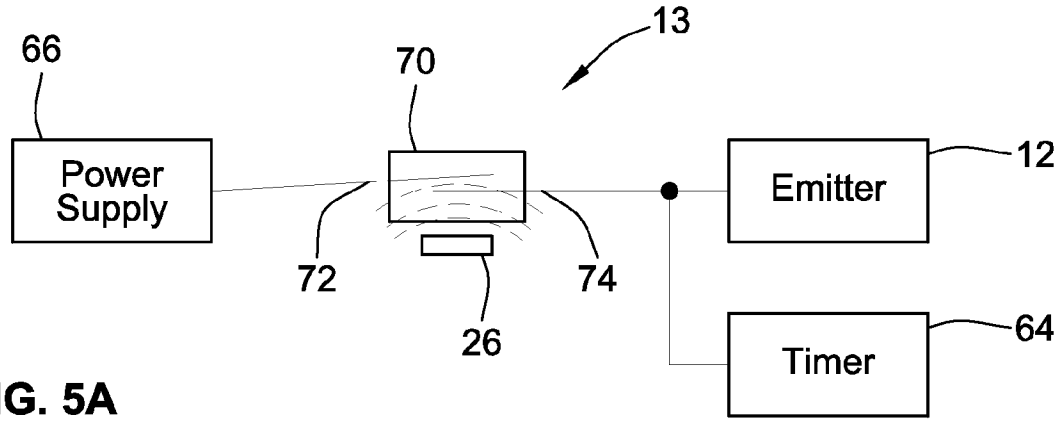
FIG. 5A is a schematic representation of an embodiment of a signal emitting retail device including a reed switch in an open configuration.
Figure 5B:
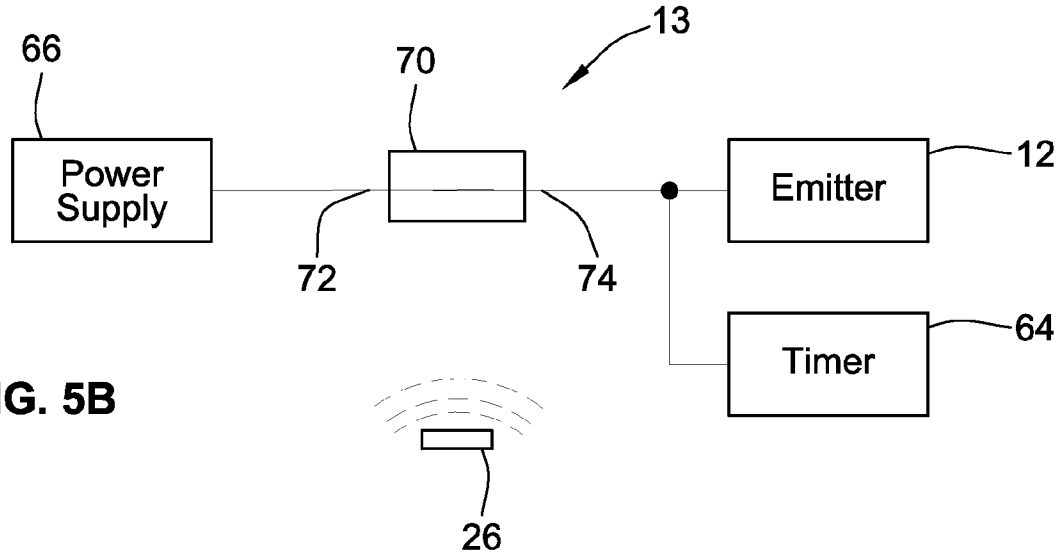
FIG. 5B is a schematic representation of an embodiment of a signal emitting retail device including a reed switch in an open configuration.

With reference to FIGS. 5A and 5B, in one embodiment, the sensor 13 includes a reed switch 70 with a pair of leads 72 and 74. The first lead 72 is electrically coupled with the power source 66 and the second lead 74 is electrically coupled with the emitter 112. The reed switch 70 is a normally closed reed switch, such that the leads 72 and 74 are normally electrically coupled, as illustrated in FIG. 5B. However, in the presence of the magnet 26, the leads 72 and 74 become disconnected.

Thus, when the label holder 24 is in the first, down, normal hanging configuration (solid line in FIG. 2), the magnet 26 is proximate the electronic unit 17, and thus, the leads 72 and 74 are in a disconnected configuration, as in FIG. 5A. However, when the label holder 24 is in the second, up, raised, merchandise removal configuration (broken line in FIG. 2), the magnet 26 is moved away from the electronic unit 17 and the leads 72 and 74 are in a connected configuration, as in FIG. 5B, connecting the power supply 66 to the emitter 12 and timer 64. Thus, in this embodiment the magnet 26 acts as the switch actuator 62 (FIG. 4). In order to remove merchandise, the label holder 24 must be moved to its second, up, raised, merchandise removal configuration, thus moving the magnet 26 away from the electronic unit 17, closing the switch 70, applying power to the timer 64 and emitter 12. Thus, signal emitting retail device 11 may be alerted to when merchandise is removed, and may, in one embodiment, keep track of available inventory on a retail display device 10 and automatically alerting store personnel or ordering additional inventory when the inventory falls below a preset level.

Additionally, a potential thief may raise the label holder 24 to its second, up raised, merchandise removal configuration for an extended period of time to allow the thief to remove large quantities of merchandise from the retail display device 10 all at once. This will cause the magnet 26 to be away from the electronic unit 17 and thus the switch 70 to be closed for an extended period of time. The timer 64, when the period of time the switch 70 is closed exceeds the predetermined period, can cause the emitter 12 to emit a second signal indicative of a potential theft condition, alerting the signal receiver unit 50 and store personnel of the potential theft condition, and thus deterring theft.

The timer 64 may be any suitable type of timer, including, for example, a digital counter, clock, etc., and may count up or count down. For example, in one embodiment upon application of power to the timer 64, the timer 64 may begin at a predetermined value and count down, where, upon reaching zero, a potential theft condition signal could be emitted by the emitter 12. In this embodiment, the timer 64 may be reset to the predetermined value. Additionally, in another embodiment, upon application of power to the timer 64, the timer 64 may begin counting up and, upon reaching a predetermined value, a potential theft condition signal could be emitted by the emitter 12. In this embodiment, the timer 64 may be reset to zero.

Figure 6A:
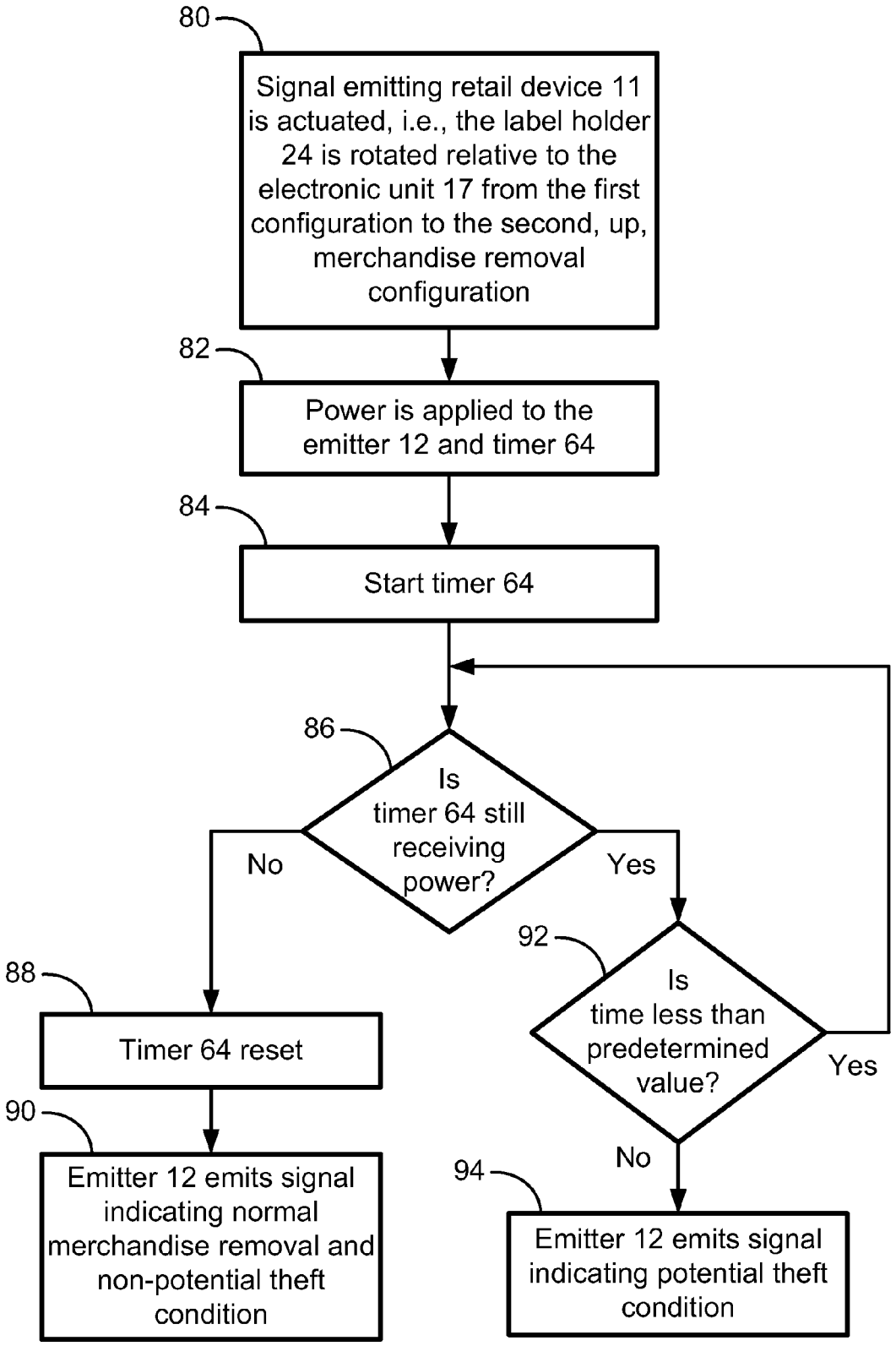
FIG. 6A is a flow diagram illustrating operation of an embodiment of a signal emitting retail device of FIGS. 2 and 3.

With reference to FIG. 6A, a flow diagram of the functionality of an embodiment is illustrated. In operation, a signal emitting retail device 11 is actuated, i.e., the label holder 24 is rotated relative to the electronic unit 17 from the first configuration to the second, up, merchandise removal configuration 80. This moves the magnet 26 (see FIG. 2) away from the electronic unit 17 (see FIG. 2). This causes the leads 72 and 74 (see FIG. 5B) to connect and the switch 60 (see FIG. 4) to close. Thus, power is applied 82 (see FIG. 6) to the emitter 12 and the timer 64. The timer is started 84. If the timer 64 stops receiving power, the timer 64 is reset 88, and the emitter 12 emits a signal indicative of a normal merchandise removal 90. As long as the timer is still receiving power, and the time is less than the predetermined value 90, the timer 64 continues timing. Once the time exceeds the predetermined value, the emitter 12 emits a second type of signal indicative of a potential theft condition 92.

Figure 6B:
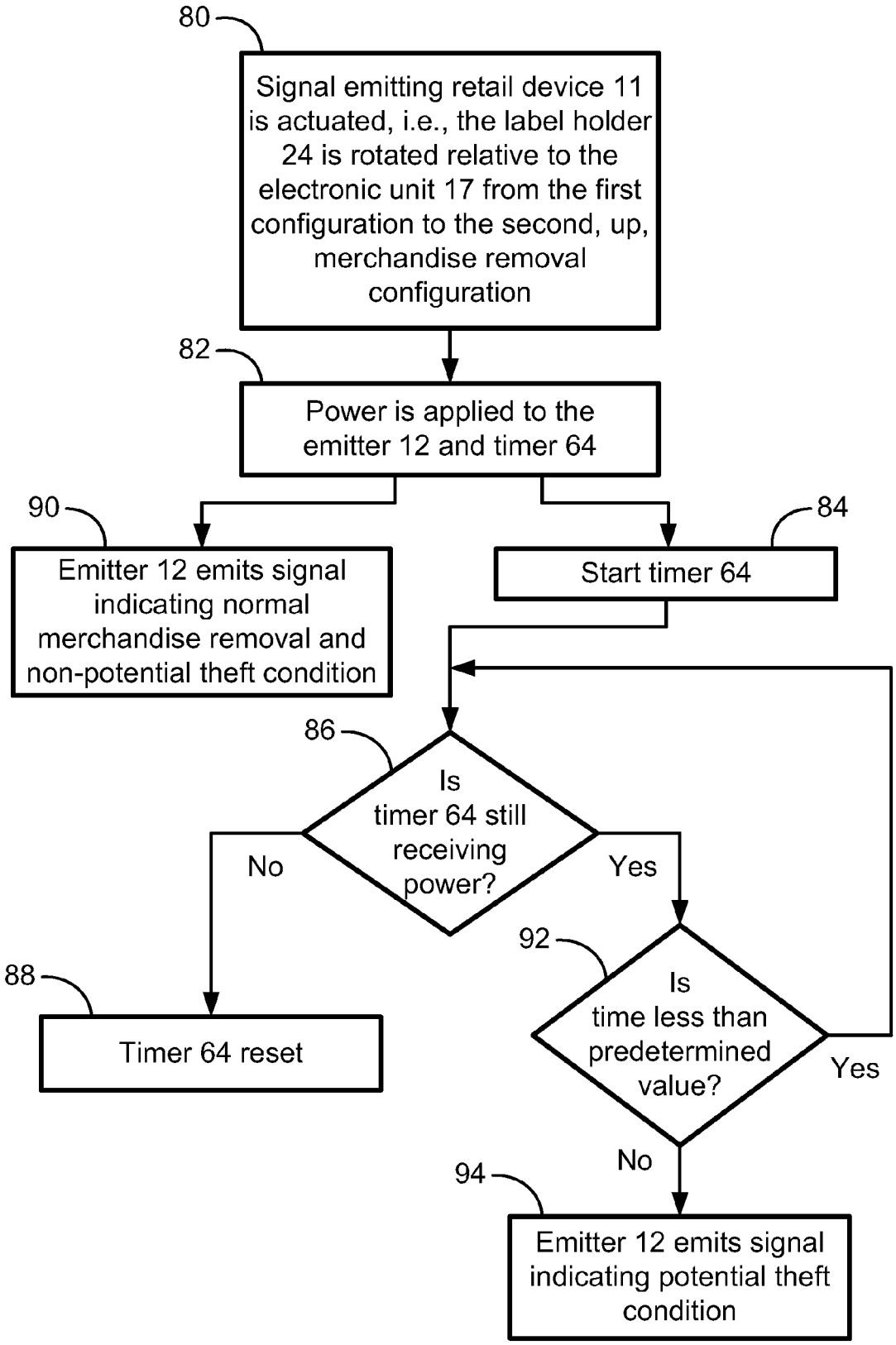
FIG. 6B is a flow diagram illustrating operation of an embodiment of a signal emitting retail device of FIGS. 2 and 3.

In another embodiment, with reference to FIG. 6B upon application of power to the emitter 12, the emitter 12 emits a signal indicating normal merchandise removal 90.

As will be understood by one having ordinary skill in the art, it is contemplated that various suitable different types of switches may be used. For example, it is envisioned that a normally open reed switch may be employed, with various suitable reconfigurations made to the system to accommodate such a type of switch.

Figure 7:
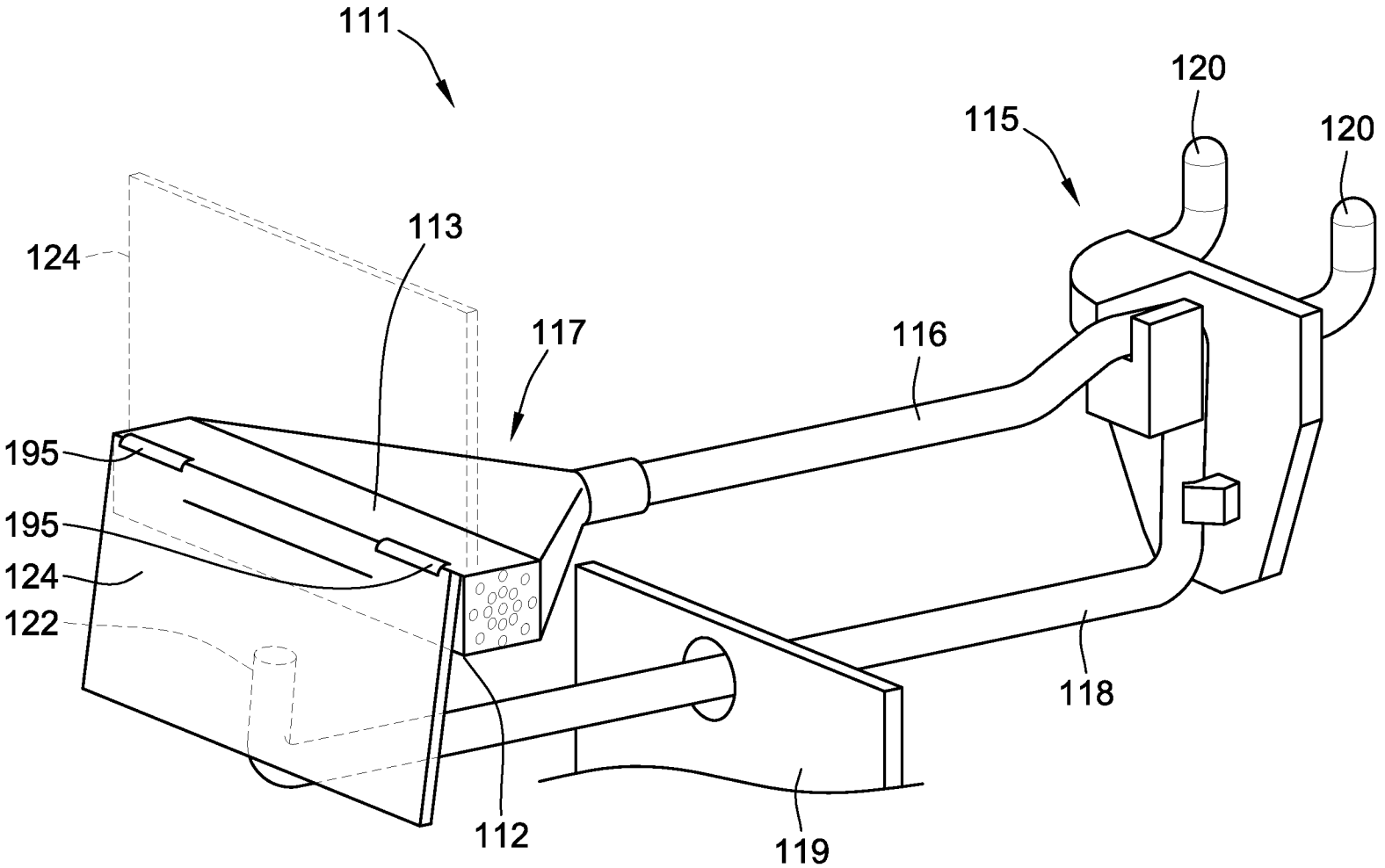
FIG. 7 is a perspective view of another embodiment of a signal emitting retail device.

With reference to FIG. 7, in one embodiment a label holder 124 is pivotally coupled to an electronic unit 117 by a pair of hinges 195. The hinges 195 are configured such that gravity pulls the label holder 124 back to its first, down, normal resting position once the merchandise 119 is removed. In a second embodiment, the hinges 128 include springs such that an additional spring force pushes the label holder 124 back to its resting position after the merchandise 119 is removed.

Figure 8:
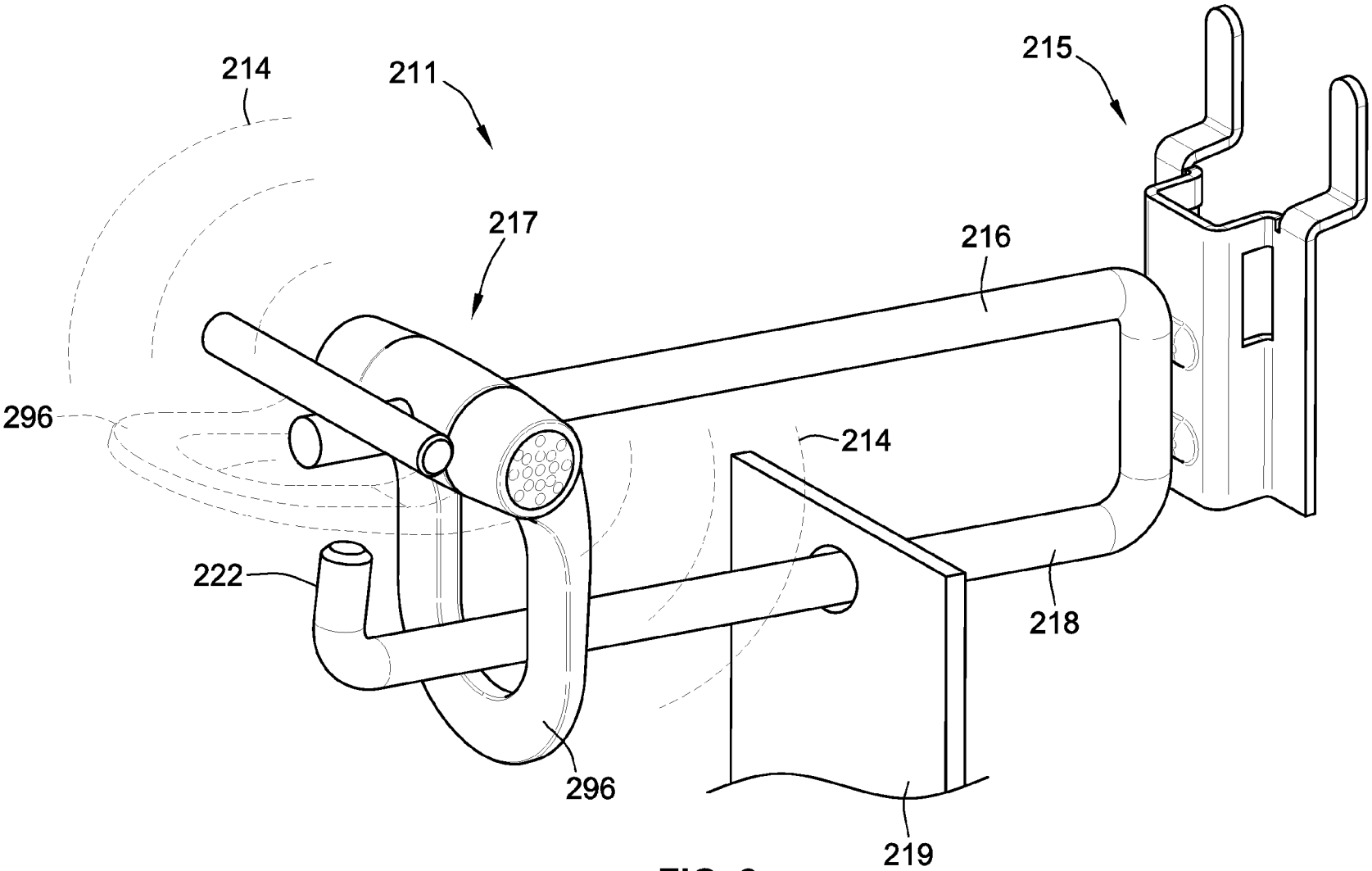
FIG. 8 is a perspective view of another embodiment of a signal emitting retail device.

With reference to FIG. 8, another embodiment of a signal emitting retail device 211 is illustrated. Several features of this embodiment of a signal emitting retail device 211 are similar to previous embodiments (i.e. the top wire 216, bottom wire 218, display interface portion 215). Various differences are discussed below.

In the illustrated embodiment of FIG. 8, the signal emitting retail device 211 includes an electronic unit 217 coupled with the top wire 216 proximate the end of the top wire 216 proximate a customer. A generally U-shaped locking mechanism 296 extends from the ends of the electronic unit 217 toward the bottom wire 218. The locking mechanism 296 is configured to wrap around the bottom wire 218 with the bottom wire 218 passing through the aperture created by the U-shaped locking mechanism 296 and the electronic unit 217 when the U-shaped locking mechanism 296 is in a first, normal, down configuration. The U-shaped locking mechanism 296 is configured to be selectively allowed to pivot relative to the top wire 216 between a first, hanging, configuration (shown in solid lines) in which merchandise 219 is not allowed to be removed from the lower wire 218, and a second, up, raised, merchandise removal configuration (shown in broken lines). The U-shaped locking mechanism 296 may in one embodiment function similarly to the label holder 24 of previously described embodiments. However, the U-shaped locking mechanism 296 in one embodiment includes additional functionality.

In one embodiment, in response to, for example, a signal from store personnel, detection of a potential theft condition, or any other suitable signal, the U-shaped locking mechanism 296 may move itself to and/or lock itself in the first, down configuration in which merchandise 219 is not allowed to be removed from the lower wire 218.

Figure 9:
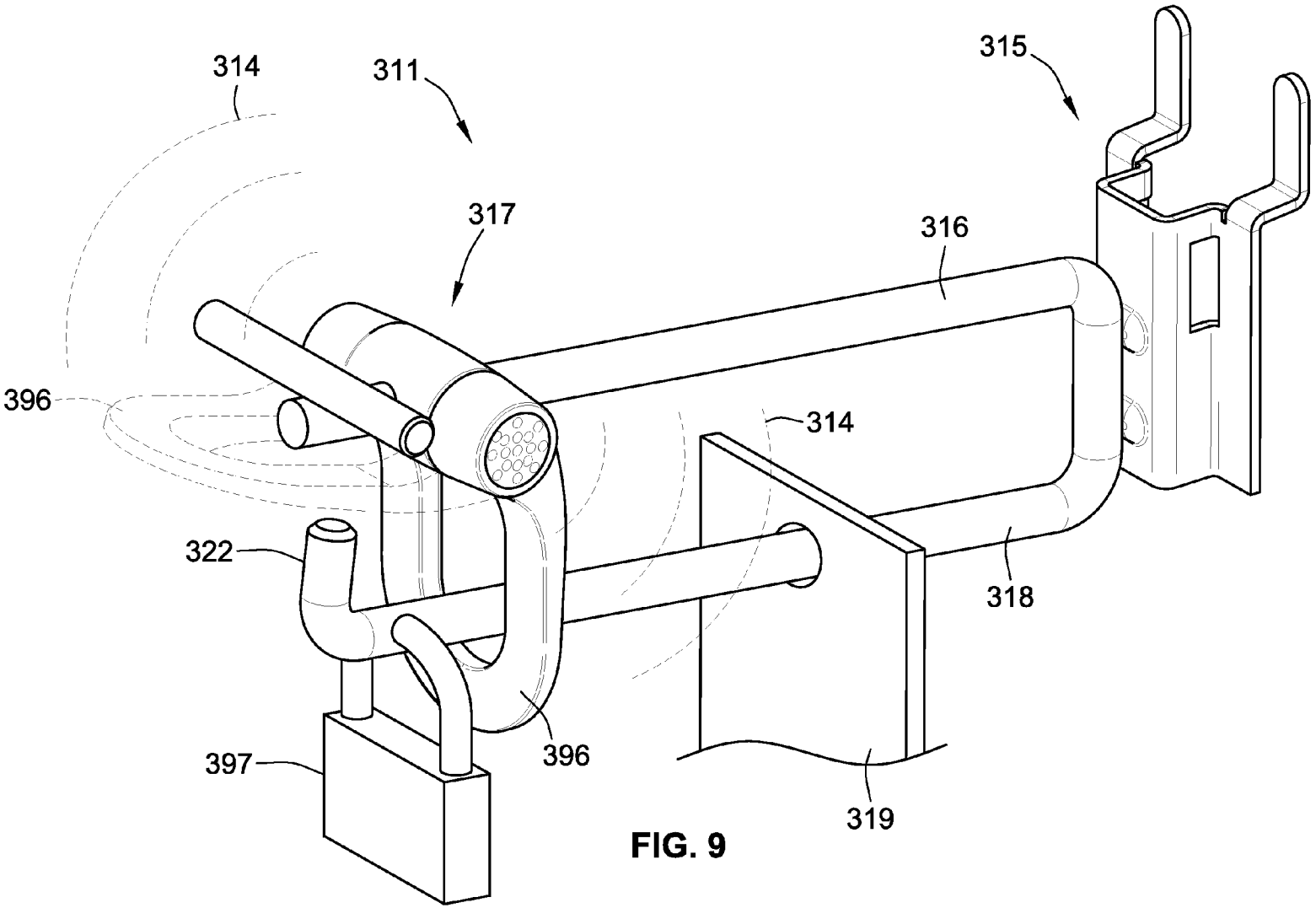
FIG. 9 is a perspective view of another embodiment of a signal emitting retail device.

With reference to FIG. 9, in another embodiment a U-shaped locking mechanism 396 is provided. Additionally, the bottom wire 318 is provided with an aperture to receive a lock 397. When the lock 397 is attached, the U-shaped locking mechanism 396 is prevented from pivoting forward and merchandise is not allowed to be removed from the bottom wire 318. The U-shaped locking mechanism 396 is pivotally coupled with the electronic unit 317 and biased towards its second, up configuration in which merchandise may be removed from the bottom wire 318, but, while the lock 397 is in place, the U-shaped locking mechanism 396 is prevented from pivoting to this second configuration. When the lock 397 is removed, the U-shaped locking mechanism 396 pivots upward to its second configuration and the electronic unit 317 is activated. In this embodiment, the sensor of the electronic unit 317 may be any suitable type of sensor to sense removal of merchandise 319. Additionally, the U-shaped locking mechanism 396 of this embodiment may be used in combination with the label holder and sensor (e.g., reed switch) arrangement discussed above.

Additionally, in another embodiment, instead of having the bottom wire 318 define an aperture to receive the lock 397, the lock 397 may be configured to instead have the bottom wire 318 pass through the aperture defined by the lock 397 when merchandise is to be prevented from being removed from the bottom wire 318.

Figure 10:
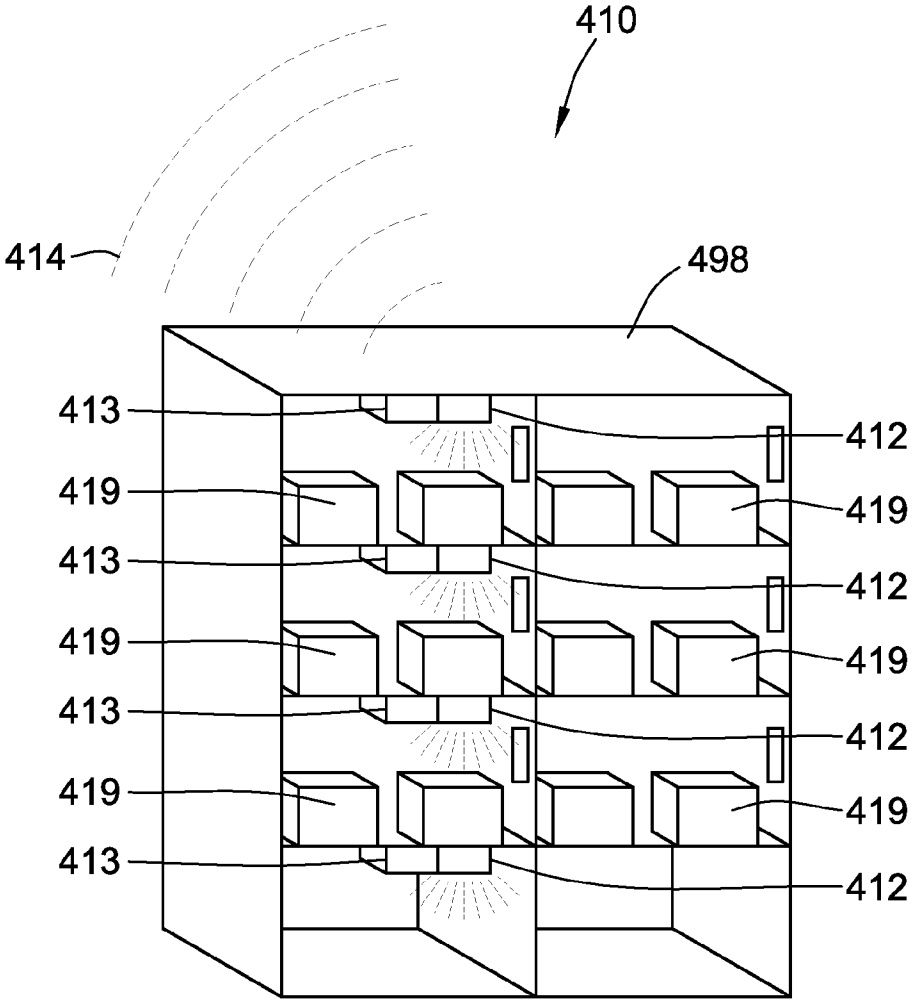
FIG. 10 is another embodiment of a retail display device of FIG. 1.

In another embodiment, with reference to FIG. 10, a retail display device 10 includes a cabinet 498. The cabinet 498 includes doors which must be opened to allow a customer to remove a piece of merchandise 419. The sensors 413 are configured to detect the opening of the doors. Upon opening of a door, the emitters 412 are configured to emit a signal indicative of a normal condition of removal of a piece of merchandise. Additionally, the sensors 413 are configured to detect when the doors have been open for longer than a predetermined time period. When the sensors 413 detect that the time period for which the doors have been opened exceeds a predetermined time period, the emitter 412 is configured to emit a signal indicative of a potential theft condition.

In another embodiment, sensors are configured to detect removal of pieces of merchandise from the cabinet 498. The sensors may be any suitable type of sensors for sensing removal of merchandise 419. In one embodiment the sensors are pressure sensors which are configured to detect changes in pressure caused by removal of merchandise 419 from shelves of the cabinet 498. Additionally, the sensors are configured to detect when more than a predetermined amount of merchandise is removed within a predetermined time period, for example, a decrease in pressure on the shelves greater than a preset decrease in pressure during a predetermined time period. When the sensors sense such a condition, the emitters are configured to emit signals indicating a potential theft condition. Other suitable types of sensors are also envisioned.

In some embodiments, signal emitting retail devices are configured to be installed on preexisting cabinets, shelves, etc. In some embodiments, electronic units, such as those illustrated in FIGS. 2, 3, and 7-9 are configured to be installed on preexisting retail display devices including preexisting top and bottom wires and label holders. In this manner, existing retail display structures may be retrofitted with electronic units to create various alarm devices 10 without resulting in any shelving space downtime.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A signal emitting retail device, comprising:

a first merchandise support portion and a second portion actuateable between a first configuration in which merchandise is prevented from being removed from the first merchandise support portion and a second configuration in which merchandise is allowed to be removed from the first merchandise support portion; and an electronic unit including a sensor coupled with an emitter;

the sensor being configured to sense when the second portion is actuated from the first configuration to the second configuration;

the emitter being configured to emit a signal based on the sensor sensing that the second portion has been actuated from the first configuration to the second configuration;

wherein the first merchandise support portion includes a bottom wire configured to support merchandise; and wherein the signal emitting retail device further comprises a top wire configured to support the second portion.

2. The signal emitting retail device of claim 1, wherein the second portion comprises a locking mechanism biased towards the second configuration;

wherein actuation of the locking mechanism activates the electronic unit; and wherein the bottom wire is configured to support a lock arranged to maintain the locking mechanism in the first configuration.

3. The signal emitting retail device of claim 1, further comprising a timer;

wherein the timer begins measuring time upon actuation of the second portion from the first configuration to the second configuration;

wherein if the amount of time measured by the timer exceeds a predetermined amount of time, the emitter is configured to emit a signal indicative of a potential theft condition.

4. The signal emitting retail device of claim 3, wherein the second portion may lock in the first configuration upon sensing of a potential theft condition.

5. The signal emitting retail device of claim 3, wherein the emitter is configured to emit a first audible signal when the sensors sense that the second portion has been actuated between the first configuration and the second configuration;

wherein the emitter is configured to emit a second audible signal when the amount of time exceeds the predetermined amount of time; and wherein the first audible signal and the second audible signal are each of at least one of different frequencies, wavelengths, pitches, frequencies of occurrence, and volumes.

6. The signal emitting retail device of claim 3, wherein the emitter is configured to emit at least one of audible sound waves, infrared light, visible light, radio waves, and microwaves.

7. An electronic unit for a signal emitting retail device, comprising:

an emitter coupled with a sensor:

the electronic unit being configured to couple with a device for displaying merchandise;

the sensor being configured to detect at least one of removal of merchandise from the device for displaying merchandise and actuation of the device for displaying merchandise;

the emitter being configured to emit a signal upon sensing by the sensor of at least one of removal of merchandise from the device for displaying merchandise and actuation of the device for displaying merchandise;

wherein the device for displaying merchandise includes a display hook including a device actuable between a first configuration in which removal of merchandise from the display hook is prevented and a second configuration in which removal of merchandise from the display hook is allowed; and wherein the electronic unit further comprises a timer, the timer being configured to measure a time that the device is in the second configuration;

the emitter being configured to emit a signal indicative of a potential theft condition when the amount of time that the device is in the second configuration is more than a predetermined amount.

8. The electronic unit of claim 7, wherein the sensor comprises a switch having an open position and a closed position, a first contact electrically connected to a power supply, and a second contact electrically connected to the emitter, such that when the switch is in the open position the power supply does not supply power to the emitter, and when the switch is in the closed position, the power supply supplies power to the emitter.

9. The electronic unit of claim 7, wherein the predetermined amount is adjustable.

10. The electronic unit of claim 7, wherein the device for displaying merchandise with which the electronic unit is configured to couple with is one of a unit of shelving and a cabinet.

11. The electronic unit of claim 7, wherein the signal identifies the electronic unit.

* * * * *